United States Patent [19]

Noorily

[11] Patent Number: 5,030,121

[45] Date of Patent: Jul. 9, 1991

[54] ELECTRICAL CONNECTOR WITH CONTACT WIPING ACTION

[75] Inventor: Peter Noorily, Bridgewater, N.J.

[73] Assignee: Thomas & Betts Corporation, Bridgewater, N.J.

[21] Appl. No.: 479,309

[22] Filed: Feb. 13, 1990

[51] Int. Cl.[5] ..... H01R 29/00

[52] U.S. Cl. ..... 439/188; 439/290; 439/507; 439/514

[58] Field of Search ..... 439/188, 287, 290, 507, 439/513-515, 610

[56] References Cited

U.S. PATENT DOCUMENTS

| | | | |
|---|---|---|---|
| Re. 32,760 | 10/1988 | Chandler et al. | 439/188 |
| 3,208,030 | 9/1965 | Evans et al. | 439/290 |
| 4,449,778 | 5/1984 | Lane | 339/143 |
| 4,501,459 | 2/1985 | Chandler et al. | 339/48 |
| 4,508,415 | 4/1985 | Bunnell | 339/143 |
| 4,564,259 | 1/1986 | Vandame | 439/290 |
| 4,582,376 | 4/1986 | Olsson | 339/19 |
| 4,602,833 | 7/1986 | Grabbe et al. | 339/19 |
| 4,619,494 | 10/1986 | Noorily et al. | 339/103 |
| 4,641,906 | 2/1987 | Olsson | 339/143 |
| 4,653,825 | 3/1987 | Olsson | 339/48 |
| 4,671,599 | 6/1987 | Olsson | 439/188 |
| 4,682,836 | 7/1987 | Noorily et al. | 439/426 |
| 4,711,507 | 12/1987 | Noorily | 439/292 |
| 4,711,511 | 12/1987 | Noorily | 439/347 |
| 4,731,032 | 3/1988 | Noorily | 439/136 |
| 4,744,769 | 5/1988 | Grabbe et al. | 439/284 |
| 4,859,201 | 8/1989 | Marsh | 439/290 |
| 4,863,393 | 9/1989 | Ward et al. | 439/188 |
| 4,883,433 | 11/1989 | Lane | 439/607 |
| 4,884,981 | 12/1989 | Chandler et al. | 439/610 |
| 4,891,022 | 1/1990 | Chandler et al. | 439/610 |

*Primary Examiner*—Paula A. Bradley

*Attorney, Agent, or Firm*—Robert M. Rodrick; Salvatore J. Abbruzzese

[57] ABSTRACT

An electrical connector for terminating conductors of a shielded multiconductor cable and for mating with a complementary electrical connector comprises an insulative housing supporting a plurality of elongate electrical contacts thereon. The contacts include a contact engaging portion and a shunt engaging portion movably supported on the housing. The contact engaging portion terminates in a curved free end that is axially movable within the housing. A pair of shunt bars is disposed transversely to and in electrical engagement with shunt engaging portions of the contacts thereby electrically commoning preselected pairs of electrical contacts when the connector is in a disconnected condition. Upon electrical connection with a complementary connector, the movable portion of the contact is moved axially in the housing as a result of the free movement of the free end of the contact, thereby causing the shunt engaging portions to move transversely relative to the shunt bars and away therefrom providing a wiping action during both connection with the complementary connector and disengagement therefrom.

15 Claims, 5 Drawing Sheets

ELECTRICAL CONNECTOR WITH CONTACT WIPING ACTION

FIELD OF THE INVENTION

The present invention relates to an improvement in electrical connectors and in particular to connectors having electrical contacts with a wiping action.

BACKGROUND OF THE INVENTION:

In the data communications industry, electrical connectors are in common use for terminating electrical cables thereto and for interconnecting various components in data communication systems. Local area network connectors are adapted to have intermateable configurations for use in the interconnection of data communications equipment. These connectors typically include electrical shields for electromagnetic emission protection and are attached to an electrically shielded cable. Such connectors further include the use of shunting mechanisms for providing a closed-loop connection between selected contact terminals when the connector is in a non-connected condition. Such a feature is provided to protect the equipment from potentially damaging electrical signals which may be transmitted to data equipment when the connector is not connected to other equipment. An example of such a connector is shown in U.S. Pat. No. 4,619,494. Similar connectors are shown in U.S. Pat. Nos. 4,682,836; 4,711,507; 4,711,511; 4,731,032; 4,501,459; Re. 32,760; 4,449,778; 4,508,415; 4,641,906; 4,653,825; 4,671,599; 4,859,201; 4,883,433; 4,884,981 and 4,891,022.

It has been recognized that in this type of electrical connector, because of environmental conditions, oxides may build up on either the shunt bars or the contacts. This may result in either incomplete or intermittent shunting between contacts when the connector is in a disconnected state. Several attempts at addressing this problem by providing a wiping action between the contacts and the shunt bars are shown in U.S. Pat. Nos. 4,582,376; 4,602,833; and 4,744.769.

SUMMARY OF THE INVENTION

It is an object of the present invention to provide an improved electrical connector.

It is a further object of the present invention to provide an electrical connector which includes wiping action between the shunting element and the connector contacts.

In accordance with the invention, an electrical connector is provided for terminating conductors of a multiconductor cable and for mating with a complementary electrical connector. The connector comprises an insulative housing having a mating portion and a cable termination portion. A plurality of elongate electrical contacts are supported by the housing. Shunt means is supported by the housing transversely relative to the contacts, the shunt means electrically commoning at least one pair of the electrical contacts. The commoned electrical contacts each include a terminal portion and a movable portion. Each terminal portion is fixedly disposed on the housing adjacent the housing cable termination portion for termination to a conductor of the multiconductor cable. The movable portion comprises a shunt engaging portion and a contact engaging portion. Each shunt engaging portion is movable from a first position in engagement with the shunt means to a second position separated from the shunt means. Each contact engaging portion has a surface for engagement with a surface of a contact in a complementary connector and terminates in a free end adjacent to and facing the mating portion of the housing. The free end is supported in the housing for free axial movement such that upon engagement of the contact engaging portion with a contact of a complementary connector, the movable portion is moved axially, thereby producing a wiping action of the shunt engaging portion relative to the transversely disposed shunt means.

In accordance with a further aspect of the invention, two different hermaphroditic connectors are intermated with each other. The first hermaphroditic electrical connector includes an insulative housing with a plurality of electrical contacts supported thereby, the contacts including a contact engaging portion of a given configuration. This first hermaphroditic electrical connector is mechanically and electrical mateable with a like first hermaphroditic connector. The second hermaphroditic connector is different from the first hermaphroditic connector. The second connector comprises an insulative housing and a plurality of contacts supported thereby, the contacts of the second connector each including a contact engaging portion in configuration different from the given configuration of the contact engaging portions of the first connector. This second hermaphroditic connector is mechanically and electrically mateable with a like second hermaphroditic connector. This second hermaphroditic connector has its housing mating portion and the contact engaging portions of its contacts in a configuration providing for mating with the first hermaphroditic connector.

DETAILED DESCRIPTION OF THE PREFERRED EMBODIMENTS

Figure 1:
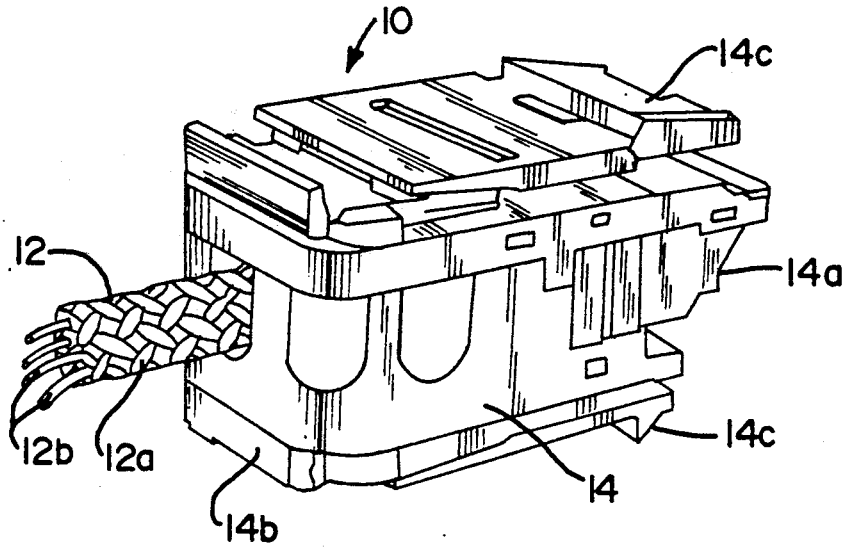
FIG. 1 is a side perspective view of an electrical connector in accordance with the subject invention, terminated to a shielded multiconductor electrical cable.

Referring now to the drawings, there is shown in FIG. 1 an hermaphroditic electrical connector 10 in accordance with the subject invention. Connector 10 is shown terminated to a shielded multi-conductor cable 12, cable 12 comprising an outer metallic braid **12*a* and four insulated conductors 12*b*. Connector 10 comprises an insulative housing 14 having a front mating face 14*a* and a rear cable termination section 14*b*. Latches 14*c* are included on the upper and lower surfaces of the housing 14 for mechanical connection to a complementary mateable electrical connector. Electrical connector 10 is of the type comprising a shunting mechanism wherein preselected contacts, as will be described hereinbelow, are electrically commoned to each other when the electrical connector 10 is in an unmated condition. The details of the construction of electrical connector 10** are substantially the same as the shielded electrical connector shown and described in commonly assigned U.S. Pat. No. 4,619,494, the details of which are herein incorporated by reference. The improvement of the subject invention resides in the configuration and function of the connector contacts which, as will be described in detail hereinafter, provide a wiping action with respect to the shunt bars in the shunting mechanism.

Figure 2:
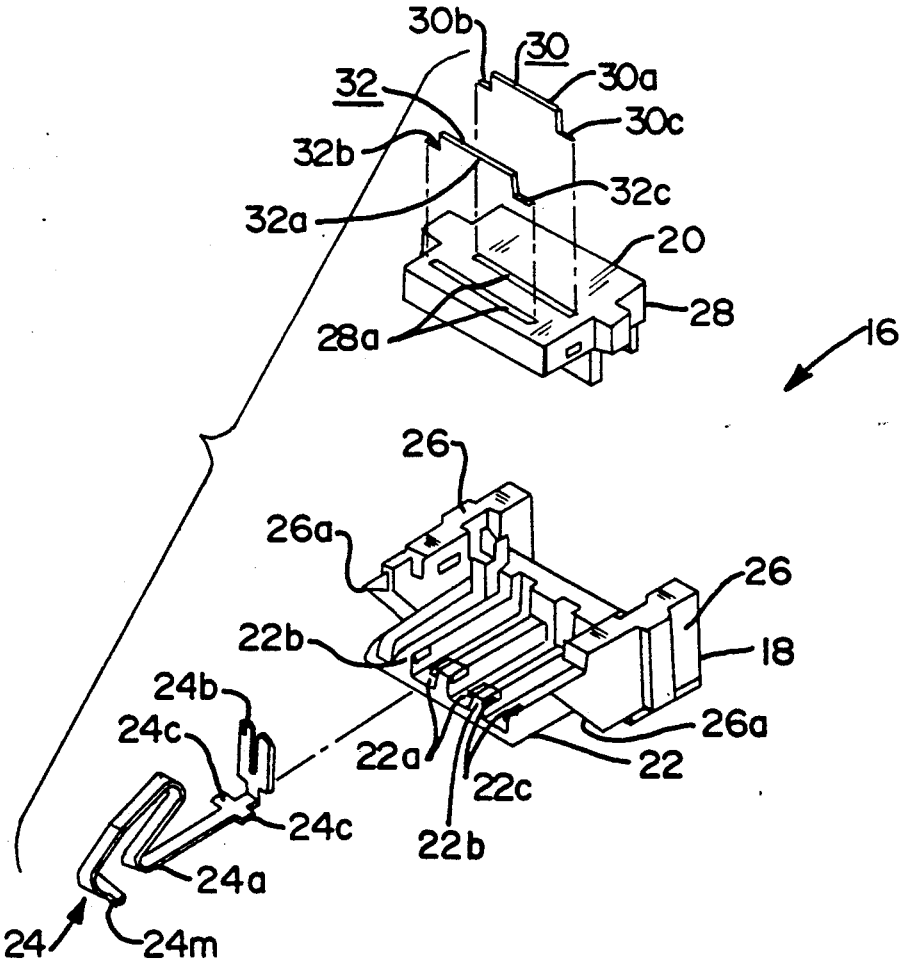
FIG. 2 is an exploded perspective view of the connector cable termination sub-assembly.

Turning now to FIG. 2, the components of a cable termination sub-assembly 16 are illustrated. Assembly 16 comprises an electrically insulative contact support holder 18 and an electrically insulative shunt supporting block 20. Holder 18, preferably formed of a molded plastic material, comprises a bottom wall 22 having four substantially parallel channels 22*a* formed therein, each channel being insulated by a partition 22*b* upstanding from the bottom wall 22. Holder 18 supports in each of its channels 22*a* a generally elongate electrical contact 24 formed of a suitably conductive material, such as phosphor bronze or beryllium copper. Holder 18 further comprises two transversely spaced upstanding walls 26, the front edges 26*a* of which are formed at an inclined angle, preferably 45 degrees, to facilitate mechanical interconnection to a complementary mateable connector.

Shunt support block 20, preferably formed of molded plastic, comprises a generally flat body 28. Formed through the upper and lower surfaces of body 28, are a pair of slots 28*a*. A pair of shunt bars 30 and 32 are retentively supported in the block 20. Each shunt bar 30 and 32 comprises a generally elongate shaft 30*a* and 32*a* and depending feet 30*b* and 30*c* and 32*b* and 32*c*, respectively. The shunt bars 30 and 32 are preferably formed of brass wire, but any suitable metal may be used. The flat body 28 of the block 20 is suitably latched to the contact support holder 18 during termination of the conductors 12*b* to contacts 24 in a manner described in above-referenced U.S. Pat. No. 4,619,494. Upon assembly of the block 20 to the holder 18, the shunt bars 30 and 32 make electrical engagement to the contacts 24. In such assembly, depending feet 32*b* and 32*c* of shunt bar 32 electrically common a first and a third contact 24 while feet 30*b* and 30*c* electrically common a second and a fourth electrical contact 24. Shunt bars 30 and 32, in such assembly, extend in a direction transverse to the generally longitudinal direction of the elongate contacts 24, and preferably perpendicular thereto.

Figure 3:
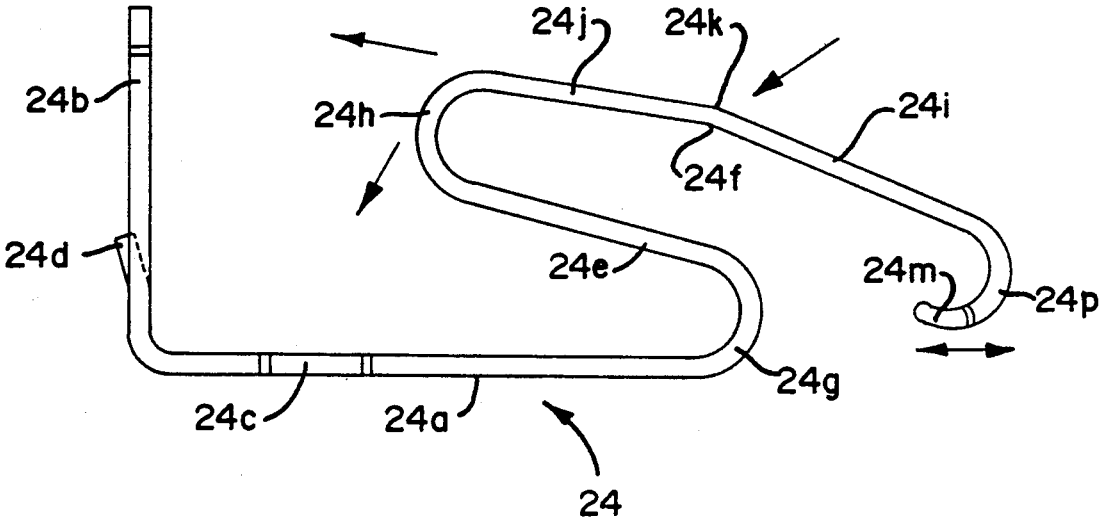
FIG. 3 is a side elevation view of a preferred electrical contact of the subject electrical connector.
Figure 4:
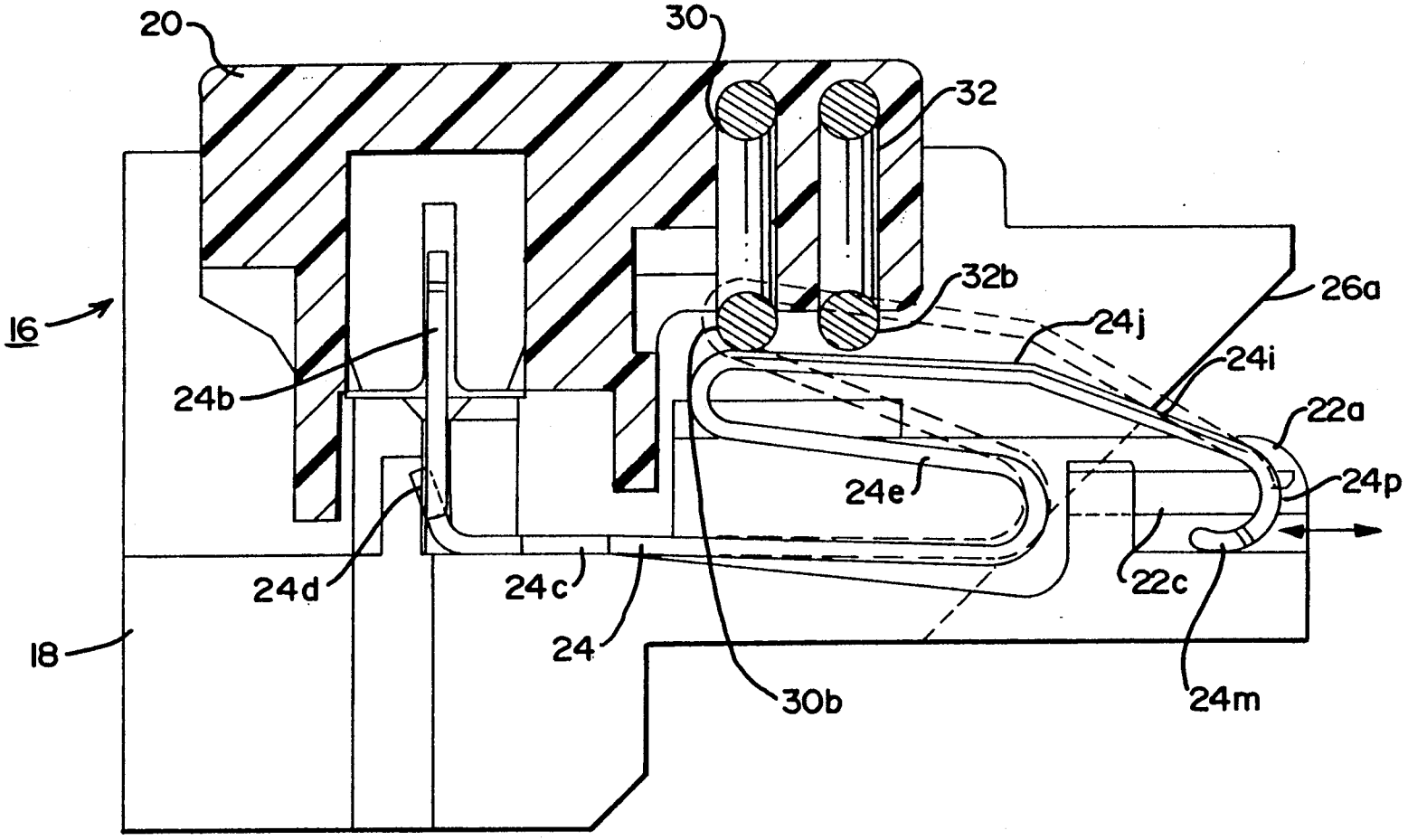
FIG. 4 is a sectional view of the assembled sub-assembly of FIG. 2.

Referring still to FIG. 2 and turning now also to FIGS. 3 and 4, the details of the improved contact in accordance with the subject invention may be more fully understood. Electrical contact 24 is preferably integrally formed by stamping the contact from a sheet of conductive material. Contact 24 generally comprises a flat elongate base 24*a* from which projects upwardly, and preferably perpendicular thereto, a flat-blade type, insulation displacement contact (IDC) 24*b* for termination to the insulated conductors 12*b*. Locking tangs 24*c* project laterally outwardly from base 24*a* while locking tang 24*d* projects rearwardly from the IDC termination portion for suitably securing the electrical contacts respectively within the channels 22*a* of holder 18. Attached to the base 24*a* by a flexible spring portion 24*e* is a movable contact portion 24*f*. In the preferred configuration, the flexible spring portion 24*e* is formed in a generally S-shaped configuration having a lower curved section 24*g* curving rearwardly and an upper curve section 24*h* curving forwardly and attached to the movable contact portion 24*f*. The movable portion 24*f* comprises a forward contact engaging portion 24*i* and a rearward facing shunt engaging portion 24*j*. The shunt engaging portion 24*j* and the contact engaging portion 24*i* are preferably separated by an apex 24*k*. The shunt engaging portion generally inclines rearwardly from the apex 24*k* and the contact engaging portion 24*i* generally inclines forwardly toward the mating end of the connector. The front end of the contact 24 at the contact engaging portion 24*i* terminates in a free end 24*p*, which is preferably formed in a rearwardly curved portion. Projecting laterally outwardly from the free curved end 24*p* are laterally extending securement elements 24*m*. As shown in FIGS. 2 and 4, the securement elements 24*m* are particularly configured to engage cooperative insulative tabs 22*c* projecting from the partitions 22*b* into the channel housings 22*a* to provide for free axial movement of the free end 24*p*. Such a construction prevents both sideways lateral movement and upward transverse movement of the free end in the channels 22*a*. As further illustrated in FIG. 4 which shows the assembly of the contact support holder 18 and the shunt support block 20, it can be seen that the shunt bars 30 and 32 engage the shunt engaging portion 24*j* of the contacts 24. In such assembly, the contacts 24 are pre-biased from a position shown in phantom to a position shown by the solid lines in FIG. 4.

Figure 5:
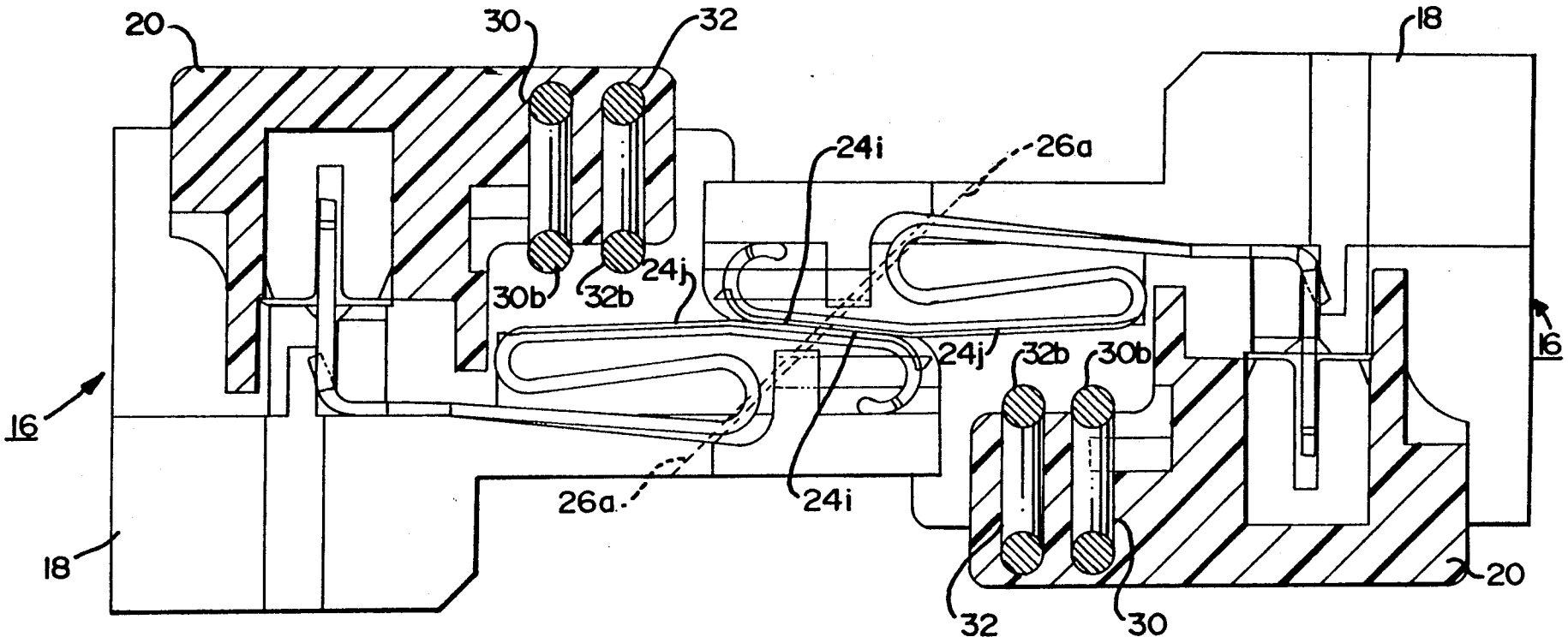
FIG. 5 is a sectional view showing the mating interconnection of the cable termination sub-assemblies of two like hermaphroditic connectors of the subject invention.

Referring now to FIG. 5 and also to FIG. 3, the effects of mating the electrical connector 10 with a complementary mateable connector are shown. In FIG. 5, the cable termination sub-assemblies 16 of identically constructed hermaphroditic connectors are illustrated in interconnection. During the interconnection of like hermaphroditic connectors 10, the mating portions 26*a* of the front end of the cable termination sub-assembly 16 are joined. During mating, the contact engaging portions 24*i* of each of the contacts 24 engage contact engaging portions of the like complimentary connector. As such engagement is made and as the connectors are urged toward each other, the movable portions 24*f* of each of the commoned contacts 24 are moved in a manner such that each shunt engaging portion 24*j* is separated from the shunt bars 30 and 32. The movable portions 24*f*, as depicted in FIG. 3, move downwardly upon flexure of the spring portion 24*e*, in a manner shown by the arrows. Further, inasmuch as the front curved end 24*p* is axially free, the free end 24*p* moves axially upon connector mating, thereby causing axial movement of the movable portion 24*f* relative to the shunt bars 30 and 32. As a result of the axial movement of the movable portion 24*f*, the shunt engaging portions 24*j* likewise have an axial movement which is believed to cause a wiping action between the shunt engaging portions and the shunt bars 30 and 32. It should also be appreciated that upon separation of the connectors and the release of the interconnection forces on the contacts 24, a similar axial movement of the moveable portion 24 is believed to occur, thereby causing a wiping action against the shunt bars 30 and 32 upon return to engagement against the shunt bars when the connectors are in disconnected fashion.

Figure 6:
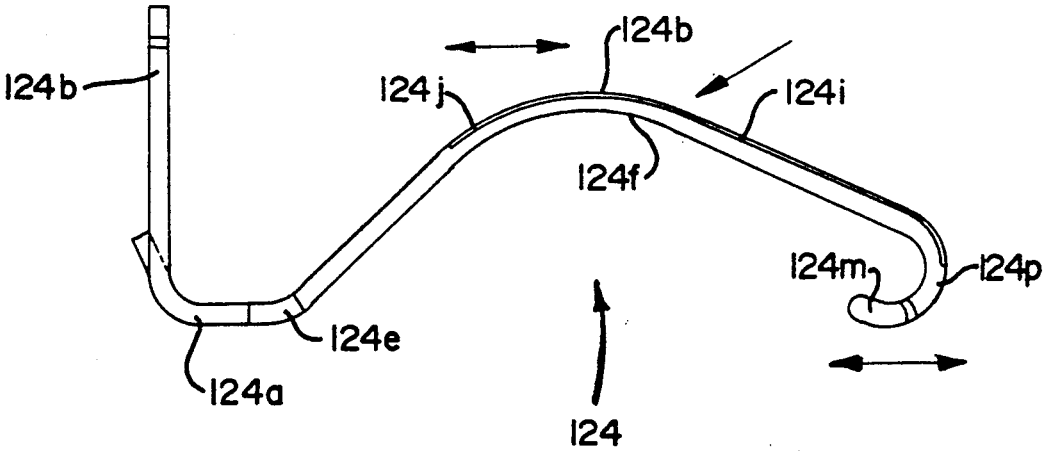
FIG. 6 is a side elevation view of an alternative contact in accordance with the subject invention.

Having described the preferred embodiment of the connector of the subject invention, it should be appreciated that variations may be made thereto without departing from the contemplated scope of the invention. For example, as shown in FIG. 6, the electrical contact may be configured in a manner as shown to provide similar advantages as the contact described hereinabove with respect to FIG. 3. The contact illustrated in FIG. 6 is described herein with reference numerals similar to those in FIG. 3, plus 100. Thus, contact 124 is generally elongate and comprises a generally flat base 124*a* with a substantially perpendicular insulation displacement contact (IDC) portion projecting upwardly therefrom and defining a conductor termination portion. A rearwardly projecting tang 124*d* is provided for fixed securement in the contact support holder 18. Contact 124 includes a movable contact portion 124*f* movably interconnected to the base 124*a* by a flexible spring portion 124*e*. The movable portion 124*f* includes a contact engaging portion 124*i* and a shunt engaging portion 124*j* separated by an apex 124*k*. The contact engaging portion 124*i* terminates in a free curved end 124*p* from which laterally project securement elements 124*m*. Securement elements 124*m* engage cooperative tabs 22*c* on the contact holder 18 to allow the free end 124*p* to move in the axial direction while preventing sideways lateral movement within the channel 22*a* and also upper movement relative thereto. Upon engagement of the contact engaging portion 124*i* with a contact of a complementary connector, the movable portion 124*f* moves downwardly away from the shunt bars 30 and 32 (not shown) and also moves axially as shown by the arrows as a result of the freedom of the curved end 124*p* to move freely in the axial direction. As a result of this axial movement, the shunt engaging portion 124*j* also moves axially relative to the transversely disposed shunt bars and provides during such movement a wiping action relative thereto. The wiping action is similarly provided upon release of the forces allowing the contact to return elastically to its shunted condition.

Figure 7:
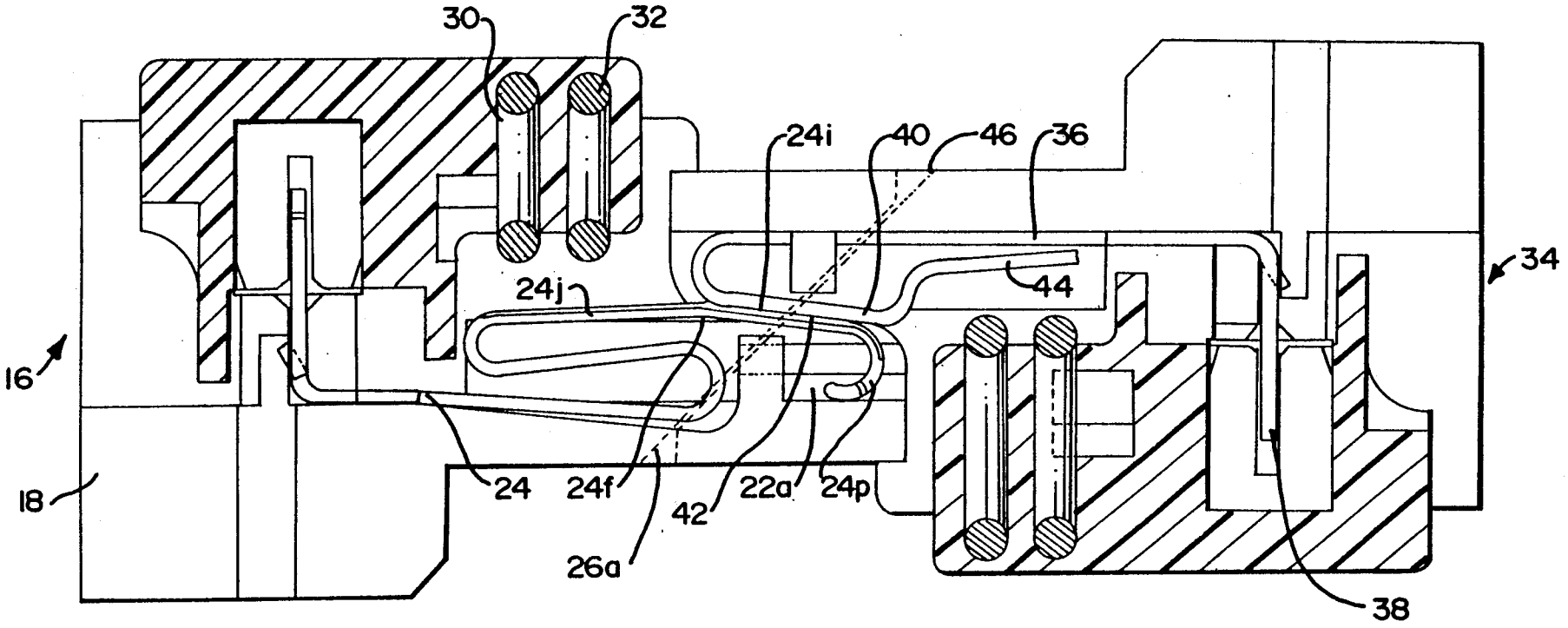
FIG. 7 is a view similar to FIG. 5 showing the mated interconnection of cable termination sub-assemblies of two different hermaphroditic connectors in accordance with the subject invention.

A further aspect of the invention is illustrated in FIG. 7 of the drawing. In the leftward portion of the drawing figure, a cable termination sub-assembly 16 as described herein is shown. As previously described with reference herein to FIG. 5, the electrical connector 10 of the subject invention is hermaphroditic and comprises contact and housing structure at the mating end thereof for mating interconnection between identical such connectors having like cable termination sub-assemblies 16. In addition to being configured for mateable interconnection with a like hermaphroditic connector, the connector 10 of the subject invention is capable of mateable interconnection with a different hermaphroditic connector having electrical contacts of different configuration than the contacts described herein.

As previously described, contact 24 has a movable portion 24*f* including a contact engaging portion 24*i* terminating in a curved free end 24*p* which is axially movable within the channels 22*a* of the contact holder 18. The contact engaging portion 24*i* is configured to have an angled surface inclining downwardly toward the mating end of the connector. As depicted in FIG. 7, a connector having the described cable termination assembly 16 is mateable with a cable termination sub-assembly different therefrom and constructed substantially as shown and illustrated in commonly assigned U.S. Pat. No. 4,619,494. The sub-assembly of the connector described in the '494 patent is shown in FIG. 7 on the righthand side of the FIG.. Thus, cable termination sub-assembly 34 has electrical contacts 36 inclusive of an insulation displacement contact (IDC) portion 38 and a movable contact portion 40, differently configured from the movable portion 24 described herein. The movable contact portion 40 has a contact engaging portion 42 and a shunt engaging portion 44. The movable portion 40 is configured in a manner that bends reversely from the front mating portion of the connector rearwardly toward the IDC cable termination portion 38. Further, the free end of the contact 36 terminates at the rearward end at the shunt engaging portion 44. The housing inclined end 26*a* of sub-assembly 16 is formed to have an incline complementary to the inclined front face 46 of the sub-assembly 34. As such, while an hermaphroditic connector having a cable termination sub-assembly 16 is mateable to a like hermaphroditic connector and while an hermaphroditic connector having cable termination sub-assembly 34 is mateable with a like hermaphroditic connector, different hermaphroditic connectors having differently configured cable termination sub-assemblies are electrically and mechanically intermateable in accordance with the invention.

Having described the preferred embodiments of the electrical connector of the subject invention herein, it should be appreciated that these embodiments are intended in an illustrative rather than a limiting sense. The true scope of the invention is set forth in the claims appended hereto.

I claim:

1. An electrical connector for terminating conductors of a multiconductor cable and for mating with a complementary electrical connector, comprising:

an insulative housing having a mating portion and a cable termination portion;

a plurality of elongate electrical contacts supported by said housing;

shunt means supported by said housing transversely relative to said contacts and electrically commoning at least one pair of said electrical contacts;

said contacts electrically commoned each including a terminal portion and a movable portion, each said terminal portion being fixedly disposed on said housing adjacent said housing cable termination portion for termination to a conductor of said multiconductor cable, each movable portion comprising a shunt engaging portion and a contact engaging portion, each said shunt engaging portion being movable from a first position in biased engagement with said shunt means to a second position separated from said shunt means, each said contact engaging portion having a surface for engagement with a surface of a contact in a complementary connector and terminating in free end adjacent to and facing said mating portion of said housing, said free end being supported in said housing for free axial movement, such that upon engagement of said contact engagement portion with a contact of a complementary connector, said movable portion is moved axially while biased against said shunt means, thereby producing a wiping action of said shunt engaging portion relative to said transversely disposed shunt means before said shunt engaging portion separates from said shunt means in said second position.

2. An electrical connector according to claim 1, wherein each contact electrically commoned includes a flexible portion between said terminal and said movable portion.

3. An electrical connector according to claim 2, wherein said flexible portion comprises a generally S-shaped spring.

4. An electrical connector according to claims 2 or 3, wherein said movable portion comprises an apex between said shunting portion and said contact engaging portion.

5. An electrical connector according to claim 4, wherein said shunt means comprises at least one shunt bar fixedly secured in said housing in engagement with said shunt engaging portions of said electrically commoned contacts, said shunt at least one bar extending in a lateral direction relative to said contacts.

6. An electrical connector according to claim 4, wherein said housing mating portion and said contacts are formed in a configuration for hermaphroditic mating.

7. An electrical connector according to claim 4, wherein said shunting portion inclines from said apex in a direction toward said terminal and said contact engaging portion inclines from said apex in a direction toward said mating portion of said housing.

8. An electrical connector according to claim 7, wherein said contacts are each integrally formed by stamping from sheet metal.

9. An electrical connector according to claim 7, wherein each said terminal comprises an insulation displacement contact formed as a generally flat blade and projecting outwardly from the axial direction of said contacts.

10. An electrical connector according to claim 4, wherein said free end of each of said electrically commoned contacts comprises means preventing movement in both directions transverse to said axial direction.

11. An electrical connector according to claim 10, wherein said preventing means comprises a curved portion and at least one element projecting laterally from said curved end.

12. In combination:

(a) a first hemaphroditic electrical connector comprising:

an insulative housing having a mating portion and a cable termination portion;

a plurality of electrical contacts supported by said housing, said contacts including a contact engaging portion of a given configuration; said first hermaphroditic electrical connector being mechanically and electrically mateable with a like first hermaphroditic connector; and (b) a second different hermaphroditic electrical connector comprising;

an insulative housing having a mating portion and a cable termination portion;

a plurality of electrical contacts supported by said housing, said contacts of said second connector including a contact engaging portion in configuration different from said given configuration of said contacts of said first connector, said contacts of said second electrical connector being elongate and terminating in free ends adjacent to and facing said mating portion of said second connector housing, said second hermaphroditic electrical connector being mechanically and electrically mateable with a like second hermaphroditic connector, said second different hermaphroditic connector having its housing mating portion and contact engaging portions of configuration providing for mating of said first and said second hermaphroditic connectors.

13. The combination according to claim 12, wherein said contacts of said second electrical connector are supported in said second connector housing such that said free ends are axially movable.

14. The combination according to claim 13, wherein said contacts of said second electrical connector comprise a terminal adjacent to said cable termination portion of said second connector housing, said contacts further including a flexible portion between said terminal and said contact engaging portion.

15. The combination according to claim 13, wherein said flexible portions comprise a generally S-shaped spring.

* * * * *